US008591348B2

(12) United States Patent
Brown et al.

(10) Patent No.: US 8,591,348 B2
(45) Date of Patent: Nov. 26, 2013

(54) STAND-ON PLAYSET SWING

(75) Inventors: Patrick W. Brown, Auburn, OH (US); John R. Nottingham, Bratenahl, OH (US); John W. Spirk, Gates Mills, OH (US); Robert F. Soreo, Cleveland Heights, OH (US); Randall Lee Day, Lamar, MO (US); Daniel Ray Whyman, Lamar, MO (US)

(73) Assignee: Backyard Leisure Holdings, Inc., Pittsburg, KS (US)

( * ) Notice: Subject to any disclaimer, the term of this patent is extended or adjusted under 35 U.S.C. 154(b) by 276 days.

(21) Appl. No.: 13/092,265

(22) Filed: Apr. 22, 2011

(65) Prior Publication Data

US 2011/0263344 A1 Oct. 27, 2011

Related U.S. Application Data

(60) Provisional application No. 61/326,865, filed on Apr. 22, 2010.

(51) Int. Cl.
*A63G 9/12* (2006.01)
*A63F 9/00* (2006.01)

(52) U.S. Cl.
USPC ..... 472/118

(58) Field of Classification Search
USPC ..... 472/118–125; 297/245, 273–282
See application file for complete search history.

(56) References Cited

U.S. PATENT DOCUMENTS

| | | | | |
|---|---|---|---|---|
| 5,163,828 | A | 11/1992 | Coddington, Jr. | |
| 5,337,449 | A * | 8/1994 | Lutzke | 16/421 |
| 5,505,664 | A | 4/1996 | Nolan et al. | |
| 6,932,710 | B1 | 8/2005 | Hartin | |
| 7,942,753 | B2 * | 5/2011 | Raredon et al. | 472/118 |

FOREIGN PATENT DOCUMENTS

JP 2009100992 A 5/2009

OTHER PUBLICATIONS

PCT Search Report and Written Opinion from PCT Application No. PCT/US2011/033534 entitled Stand-On Playset Swing (Dated Jan. 4, 2012).

* cited by examiner

*Primary Examiner* — Kien Nguyen
(74) *Attorney, Agent, or Firm* — Hovey Williams LLP

(57) ABSTRACT

A stand-on swing for suspension from a playset structure includes a platform member presenting an upper surface on which the user may stand. The swing also includes a pair of elongated, rigid suspension bars each presenting upper and lower ends. The bars are pivotally connectable to the structure adjacent the upper ends so as to depend therefrom, with the lower ends being spaced from the ground. The swing further includes a pair of lower pivot joints pivotally connecting the suspension bars to the platform member adjacent the lower ends thereof, with the platform member and bars being swingable in a fore-and-aft direction. The bars are bowed so as to present intermediate sections that are spaced further apart than the upper and lower ends. Further, the bars terminate above or generally at the platform member so that the lower ends are prevented from being spaced substantially downward beyond the platform member.

28 Claims, 6 Drawing Sheets

STAND-ON PLAYSET SWING

CROSS-REFERENCE TO RELATED APPLICATION

The present application claims the benefit of and priority from U.S. Provisional Patent Application Ser. No. 61/326,865, filed Apr. 22, 2010, the entire disclosure of which is hereby incorporated by reference herein.

BACKGROUND OF THE INVENTION

1. Field of the Invention

The present invention relates generally to children's playsets and playset accessories. More particularly, the present invention concerns a stand-on swing for use with a playset structure.

2. Discussion of the Prior Art

Those of ordinary skill in the art will appreciate that conventional playsets typically include a frame or other support structure, and a number of known play accessories (e.g., swings, slides, climbing walls, etc.) supported on or suspended from the support structure. More specifically, conventional swing accessories are configured to support the user in a seated position. Although children have been known to stand on swings, prior art designs fail to safely support the child in a standing position and such use can unduly wear and/or damage the swing.

SUMMARY

The present invention provides a stand-on swing that is specifically designed to support a user in a standing position so as to reduce the risk of injury, while being sufficiently durable and sturdy to withstand use in the intended manner.

More particularly, according to one aspect of the present invention, the stand-on swing includes a platform member presenting an upper surface on which the user may stand. The swing also includes a pair of elongated, rigid suspension bars each presenting upper and lower ends. The bars are pivotally connectable to the swing support structure adjacent the upper ends so as to depend therefrom, with the lower ends being spaced from the ground. The swing further includes a pair of lower pivot joints pivotally connecting the suspension bars to the platform member adjacent the lower ends thereof, with the platform member and bars being swingable in a fore-and-aft direction. The bars terminate above or generally at the platform member so that the lower ends are prevented from being spaced substantially downward beyond the platform member.

In accordance with another aspect of the present invention, the stand-on swing includes a platform member presenting an upper surface on which the user may stand. The swing also includes a pair of elongated, rigid suspension bars each presenting upper and lower ends. The bars are pivotally connectable to the swing support structure adjacent the upper ends so as to depend therefrom, with the lower ends being spaced from the ground. The swing further includes a pair of lower pivot joints pivotally connecting the suspension bars to the platform member adjacent the lower ends thereof, with the platform member and bars being swingable in a fore-and-aft direction. The bars are bowed so as to present intermediate sections that are spaced further apart than the upper and lower ends.

Embodiments of the present invention may also include upper pivot joints cooperatively defined by the suspension bars and a connection bracket, with bracket serving to connect the swing to a playset structure. The lower ends of the suspension bars are preferably spaced further apart from one another than the upper ends.

This summary is provided to introduce a selection of concepts in a simplified form that are further described below in the detailed description of the preferred embodiments. This summary is not intended to identify key features or essential features of the claimed subject matter, nor is it intended to be used to limit the scope of the claimed subject matter.

Various other aspects and advantages of the present invention will be apparent from the following detailed description of the preferred embodiments and the accompanying drawing figures.

BRIEF DESCRIPTION OF THE DRAWING FIGURES

A preferred embodiment of the present invention is described in detail below with reference to the attached drawing figures, wherein.

Figure 4:
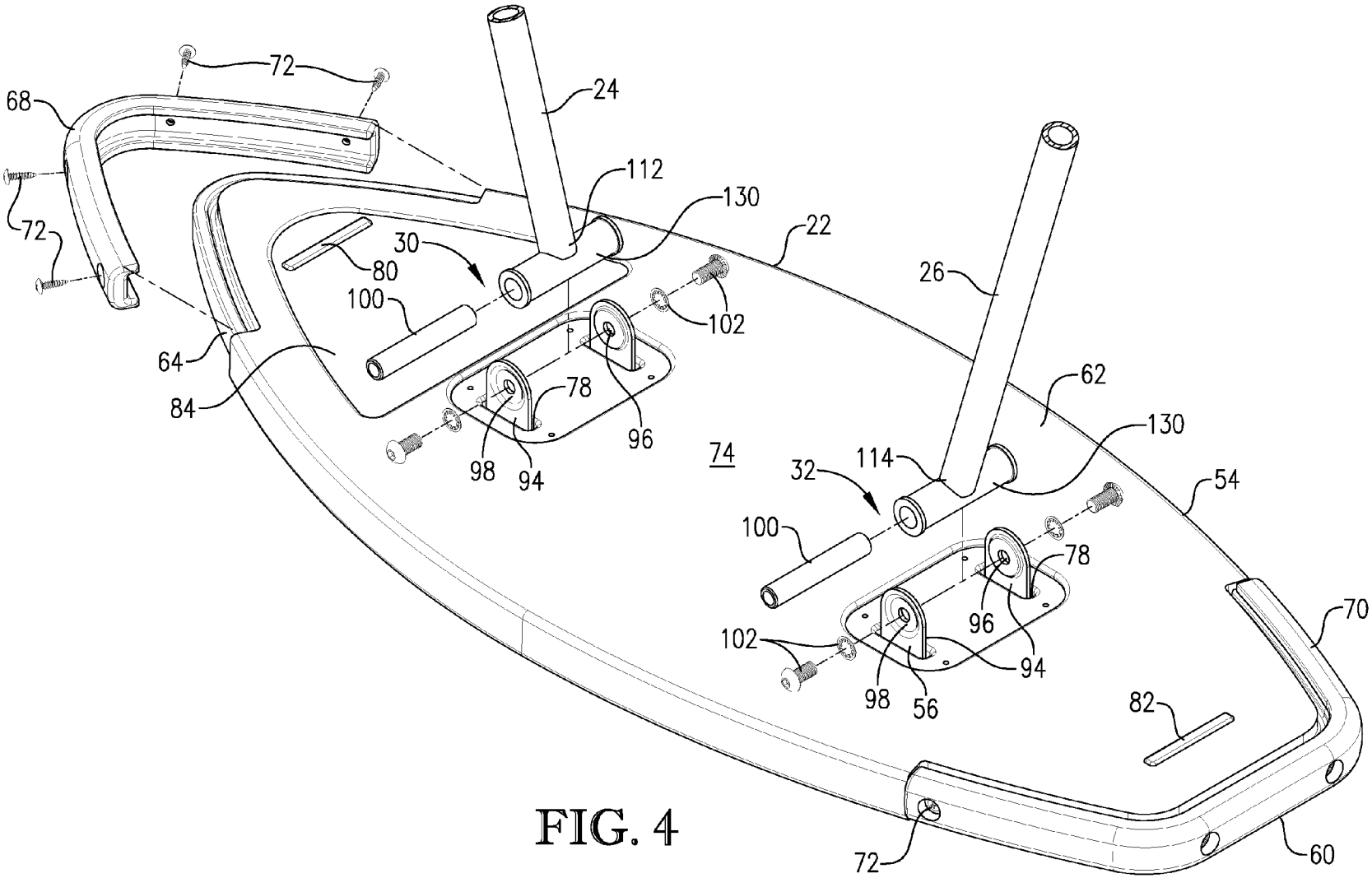
FIG. 4 is an enlarged, exploded, partial sectional, isometric view of a portion of the stand-on swing shown in FIGS. 1-3, particularly illustrating the components of the lower pivot joints.
Figure 5:
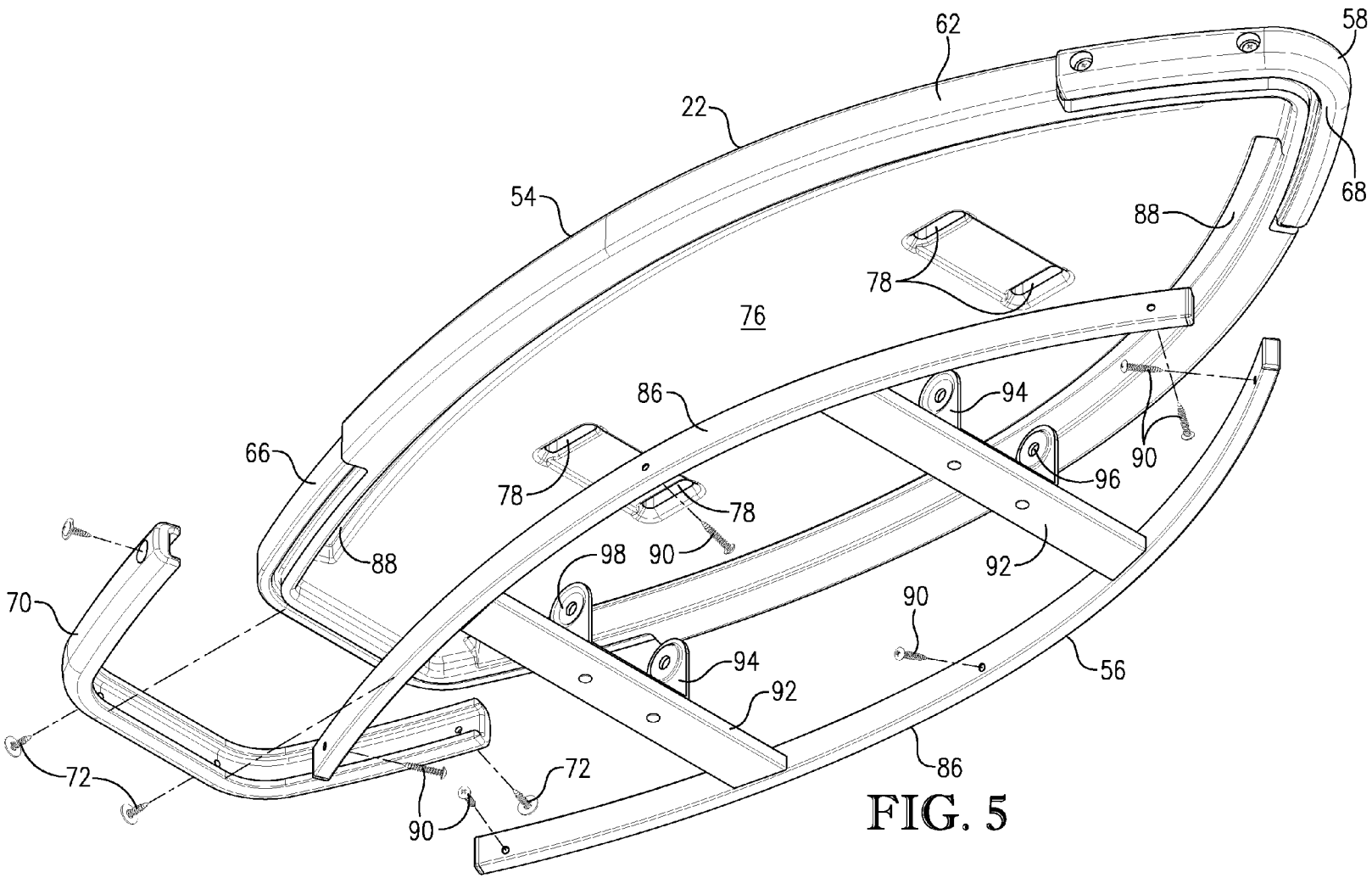
FIG. 5 is an enlarged, exploded, partial sectional, isometric view of a portion of the stand-on swing shown in FIGS. 1-4, particularly illustrating the underlying framework of the platform member.
Figure 7:
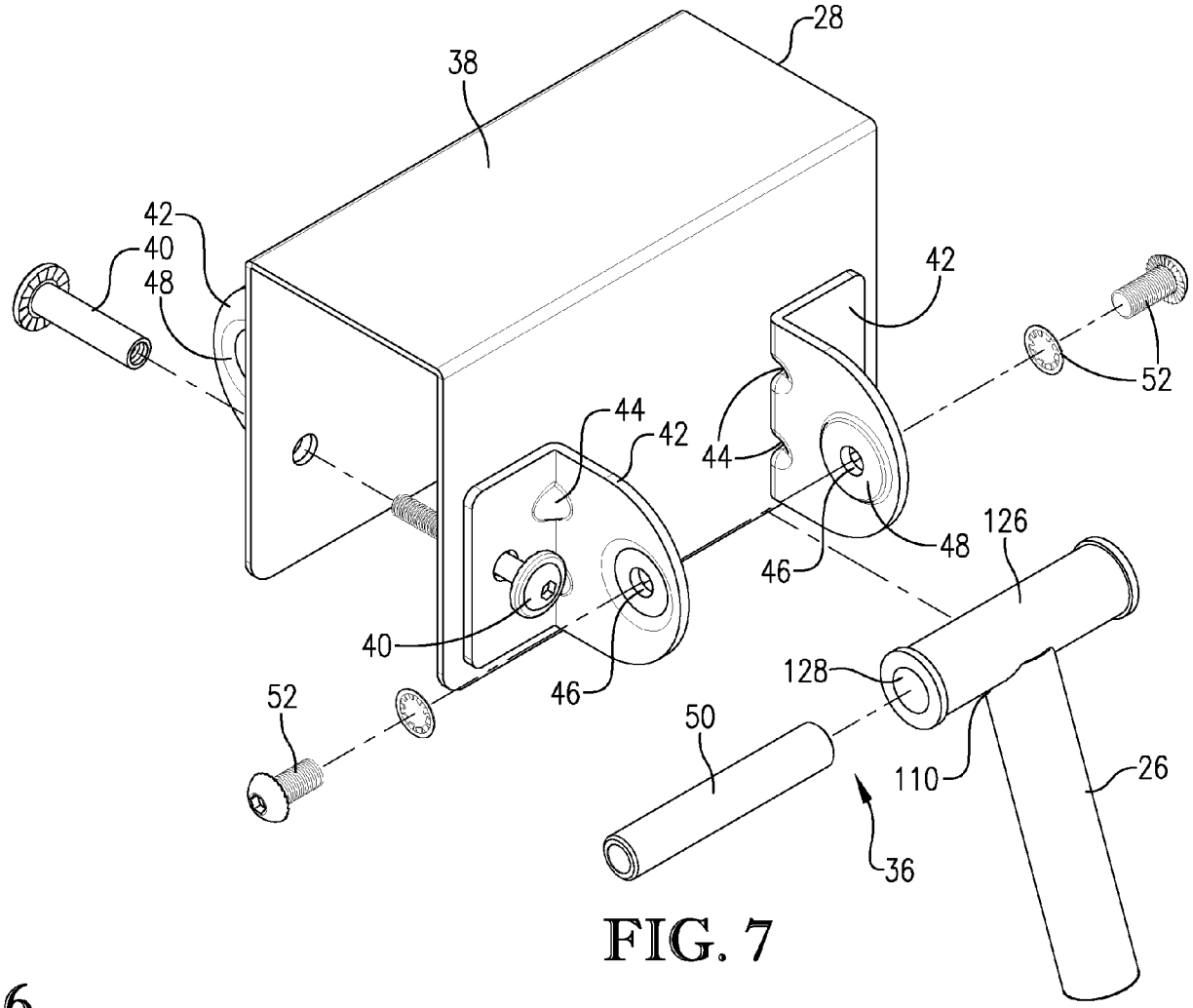
Figure 6:
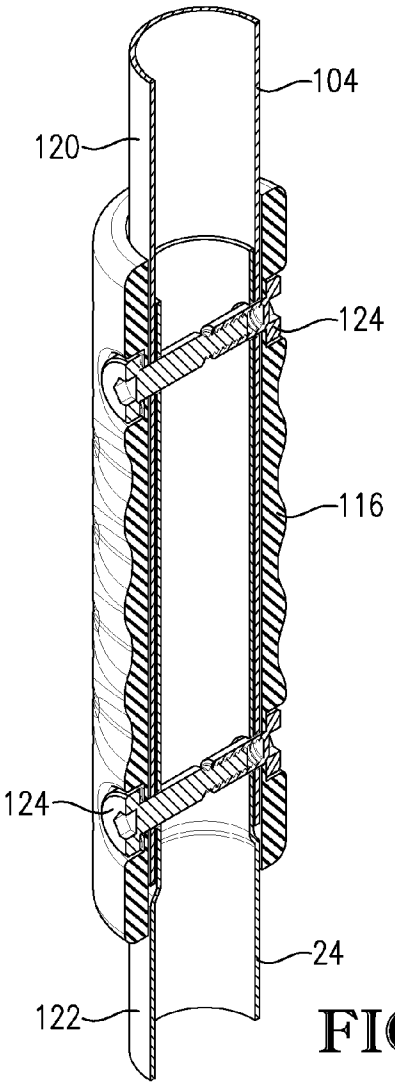

FIG. 6 is a greatly enlarged, cross-sectional view of one of the suspension bars of the stand-on swing depicted in FIGS. 1-5, particularly illustrating the construction of the handle and manner in which the telescopically interfitted sections of the bar are interconnected; and FIG. 7 is a greatly enlarged, exploded, isometric view of the upper pivot bracket of the stand-on swing depicted in FIGS. 1-5, particularly showing the construction of the upper pivot joints and the manner in which the bracket is secured to the playset structure.

The drawing figures do not limit the present invention to the specific embodiments disclosed and described herein. The drawings are not necessarily to scale, emphasis instead being placed upon clearly illustrating the principles of the preferred embodiments.

DETAILED DESCRIPTION OF THE PREFERRED EMBODIMENTS

The present invention is susceptible of embodiment in many different forms. While the drawings illustrate, and the specification describes, certain preferred embodiments of the invention, it is to be understood that such disclosure is by way of example only. There is no intent to limit the principles of the present invention to the particular disclosed embodiments.

Figure 1:
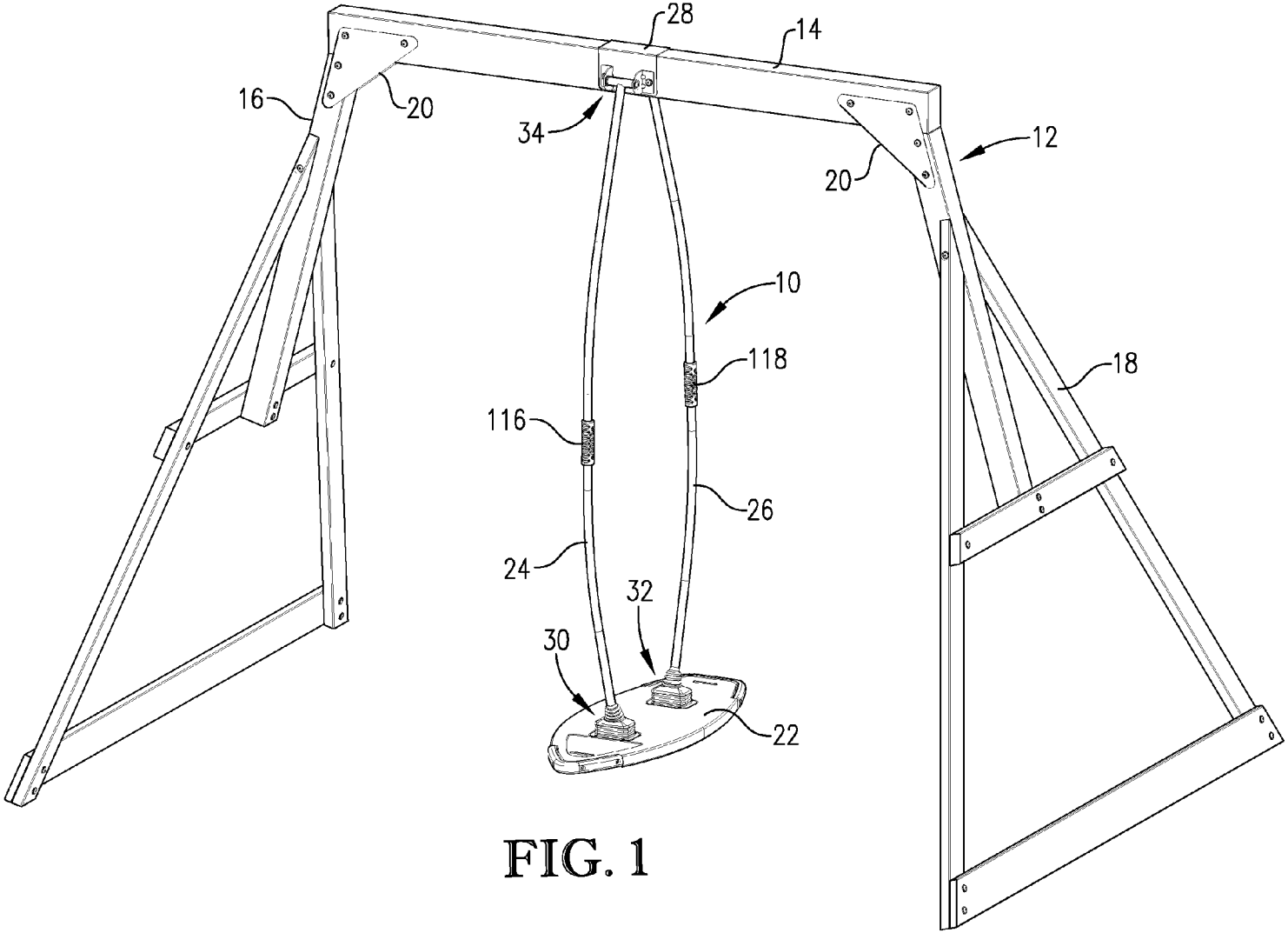
FIG. 1 is an isometric view of a stand-on playset swing constructed in accordance with the principles of an embodiment of the present invention, depicting the swing suspended from a typical playset structure.

Turning initially to FIG. 1, the stand-on swing 10 is depicted in use with the playset structure 20. In the illustrated embodiment, the structure 20 generally includes a cross-member 14 and a pair of side frames 16,18. The illustrated side frames are generally triangular in shape and serve to cooperatively support the cross-member 14 above the ground. Preferably, the cross-member 14 is supported at a height of about six (6) to ten (10) feet above the ground, although other suitable heights are within the ambit of the present invention. Gussets 20 are preferably provided at the junction defined between the cross-member 14 and each side frame 16 or 18.

As is customary, traditional hardware is used to secure the various playset structure components to one another. The elements of the playset structure 12 are typically made of wood, although it will be readily appreciated by one of ordinary skill in the art that other suitable materials could also be used.

Additionally, while the illustrated playset structure 12 supports only the suspended stand-on swing 10 described in detail herein, it will be readily appreciated that a number of known play accessories (e.g., slides, other swings, climbing walls, etc.) may also be included with alternatively constructed playset structure (not shown). Furthermore, the stand-on swing 10 may also be suspended from suitable structure other than the conventional playset structure 12 (such as from joists on the underneath side of a suspended deck; not shown) without departing from the teachings of the present invention.

The preferred swing 10 generally includes a platform member 22, a pair of suspension bars 24 and 26, a connection bracket 28, lower pivot joints 30 and 32 pivotally interconnecting the platform member 22 and bars 24 and 26, and upper pivot joints 34 and 36 pivotally interconnecting the bracket 28 and bars 24 and 26. The illustrated swing 10 is designed to swing in a fore-and-aft direction between the side frames 16 and 18.

The connection bracket 28 includes a plate 38 securely attached to the cross-member 14 by threaded fasteners 40 (e.g., see FIG. 7). The bracket 28 preferably has a shape that corresponds to that of the cross-member 14. Therefore, in the illustrated embodiment, the plate 38 has an inverted "U" shape, although the shape and dimension of the cross-member 14 and plate 38 may be varied without departing from the scope of the present invention. The bracket 28 further includes a pair of L-shaped connectors 42 extending from each side of the plate 38. Each connector 42 is provided with a pair of punched indentations 44 spaced along the corner, a fastener opening 46, and a recessed section 48 circumscribing the fastener opening 46. The fastener openings 46 of each pair of connectors 42 are aligned to receive a cylindrical shaft 50 therebetween. More specifically, a fastener 52 (preferably including a screw and lock washer) is passed through each fastener opening 46 and threaded into the corresponding end of the shaft 50. As will be described, this arrangement cooperates with complementary components on the corresponding suspension bar to define one of the upper pivot joints.

Preferably, the bracket 28 is formed of metal, such as galvanized steel or aluminum, although other suitable materials (e.g., composites, plastics, etc.) are encompassed by the principles of the present inventions. The plate 38 and connectors 42 are suitably interconnected, such as by welding. The bracket 38 is preferably centrally located along the cross-member so that the swing 10 is spaced equally from the side frames 16 and 18, although the bracket 38 and swing 10 may alternatively be positioned closer to one side of the structure 12, if desired. Furthermore, those of ordinary skill in the art will appreciate that the manner in which the suspension bars 24,26 are connected to the playset structure 12 may be varied without departing from the scope of the present invention. For example, the suspension bars 24,26 need not be coupled to the common bracket 28.

Figure 2:
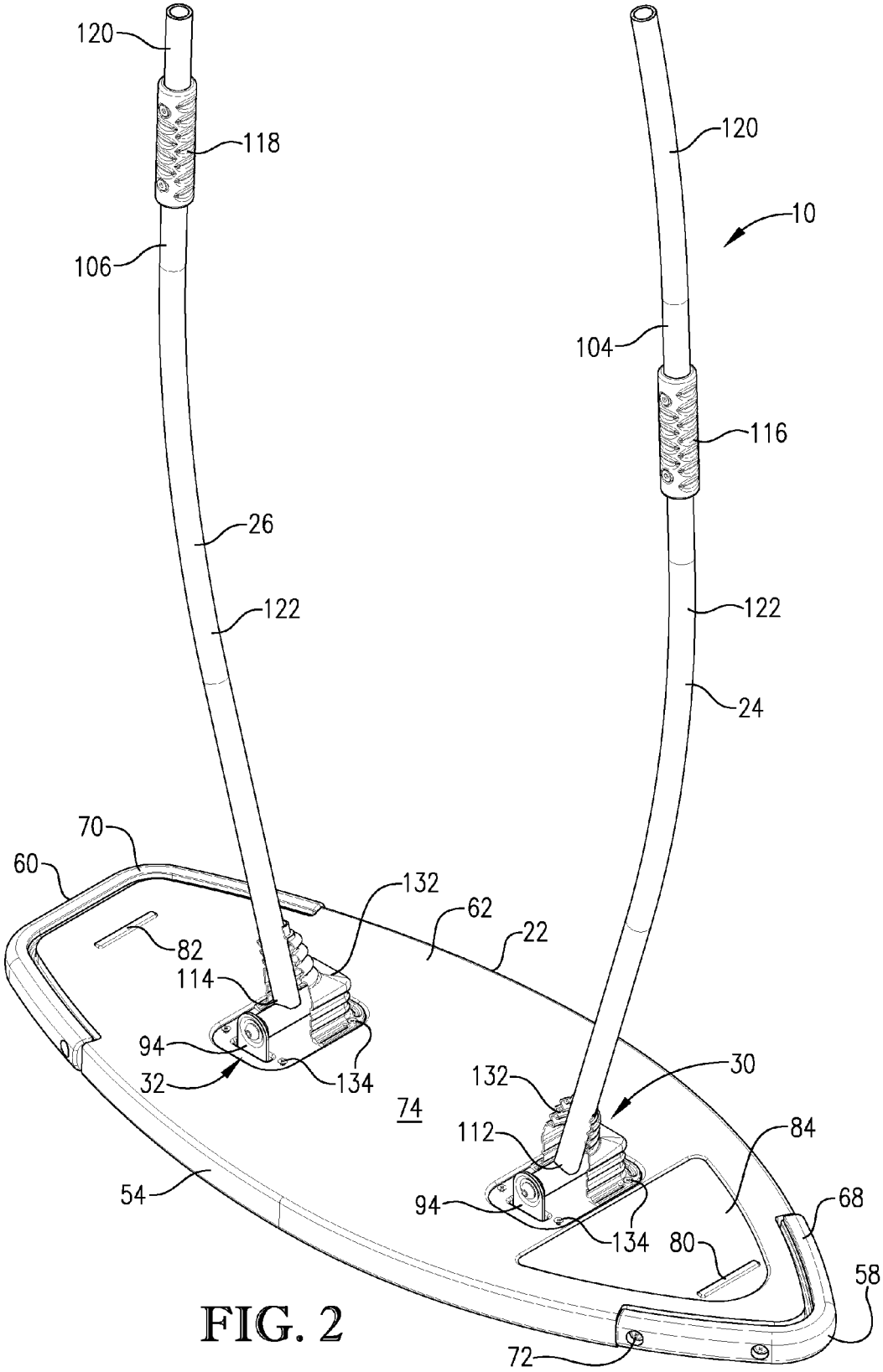
FIG. 2 is an enlarged, partial fragmentary, isometric view of the stand-on swing shown in FIG. 1, particularly illustrating the lower pivot joints interconnecting the suspension bars and the platform member, as well as the corrugated, flexible covers for the pivot joints.

As perhaps best shown in FIGS. 2, 4, and 5, the preferred platform member 22 generally includes a body 54 and a frame 56 underlying the body 54. In the illustrated embodiment, the body 54 preferably has a shape similar to that of a surfboard, with a forward pointed nose end 58 and a rear generally straight end 60. The body 54 preferably has a length of about two (2) to five (5) feet, although other suitable shapes and sizes are within the scope of the present invention.

In the illustrated embodiment, the body 54 is formed principally of a molded plastic component 62, although other suitable materials or means for making the component 62 may be used. The component 62 includes recesses 64 and 66 extending along the front and rear ends 58 and 60, respectively. The body 54 includes bumpers 68 and 70 fit within the recesses 64 and 66, respectively, and secured in place by fasteners 72 threaded into the component 62. The bumpers 68 and 70 are preferably formed of an elastomeric material. The component 62 presents a top surface 74 (see FIG. 4) and a bottom surface 76 (see FIG. 5). A plurality of frame-receiving slots 78 extend fully through the component 62 in alignment with recessed areas of the surfaces 74 and 76.

The top surface 74 is primarily flat so that the user can stand securely thereon. A pair of upstanding foot stops 80 and 82 (preferably in the form of elongated ribs projecting from flat portions of the top surface) are defined on the top surface 74 adjacent the front and rear ends 64 and 66, respectively, to further enhance secure standing on the platform member 22. It is also preferred to provide a recessed foot-receiving section 84 in the top surface 74 (with the front stop 80 being located in the section 84) to minimize the risk of the user's front foot slipping off the platform member 22. If desired, the design of the top surface 22 may be alternatively configured to facilitate secure standing of the user on the platform member 22. In the preferred embodiment, the bottom surface 76 is generally recessed so that the frame 56 can be tucked generally underneath the body 54. The configuration of the bottom surface 76 may also be varied without departing from the scope of the present invention.

The frame 56 preferably has an overall shape that generally corresponds with that of the body 54 (see particularly FIG. 5). In the illustrated embodiment, the frame 56 includes a pair of curved side members 86 that are received in complemental grooves 88 defined in the bottom surface 76. The frame 56 is secured to the body 54 by threaded fasteners 90. A pair of crossbars 92 extend between the side members 86 for placement against the surface 76. Each of the crossbars 92 is preferably aligned with a corresponding pair of slots 78. A pair of connection plates 94 project upwardly from each crossbar 92 in alignment with the slots 78. The plates 94 are dimensioned and configured to project through the body 54 and upwardly beyond the top surface 74 (see FIG. 4). Each connection plate 94 is provided with a fastener opening 96 and a recessed section 98 circumscribing the fastener opening 96. The fastener openings 96 of each pair of connection plates 94 are aligned to receive a cylindrical shaft 100 therebetween. More specifically, a fastener 102 (preferably including a screw and lock washer) is passed through each fastener opening 96 and threaded into the corresponding end of the shaft 100. As will be described, this arrangement cooperates with complementary components on the corresponding suspension bar to define one of the lower pivot joints.

The suspension bars 24 and 26 serve to suspend the platform member 22 from the bracket 28 and therefore the playset structure 12. The bars 24 and 26 are rigid and preferably bowed to present intermediate portions 104 and 106 that are spaced further apart than the upper ends 108 and 110 and lower ends 112 and 114. In the illustrated embodiment, the bars 24 and 26 are bowed in the fore-and-aft direction so that the intermediate portions 104 and 106 are spaced apart about one and one-half (1½) to three (3) feet at the widest spacing. Further, the bars 104 and 106 are provided with handles 116 and 118 to be gripped by the user when standing on the platform member 22. It is particularly noted that the handles 116 and 118 are preferably positioned centrally along the bars 104 and 106 (which preferably coincides with the widest spacing between the bars 104 and 106) and, more preferably, about two (2) to four (4) feet above the top surface 74 of the platform member 22. It is also noted that the bars 24 and 26 are preferably configured so that the lower ends 112 and 114 are spaced further apart than the upper ends 108 and 110.

The bars 24 and 26 are preferably symmetric relative to one another about a vertical axis, although bars with differing shapes and sizes are within the ambit of the present invention. It is also possible to provide more than two (2) bars, as illustrated. The bars 24 and 26 preferably have a length corresponding to the height of the cross-member 14 and the desired position of the platform member 22. It is particularly noted that the platform member 22 is preferably positioned about one and one-half (1½) to three (3) feet above the ground. Therefore, the bars 24 and 26 preferably have a vertical height of about four (4) to eight (8) feet, again depending upon the height of the cross-member 14 and the desired position of the platform member 22.

The bars 24 and 26 preferably each include upper and lower sections 120 and 122 that are partially telescopically interfitted along the respective intermediate portion 104 or 106 (see FIG. 6). In the illustrated embodiment, the lower bar section 122 includes a reduced diameter upper end that is received in the lower end of the upper bar section 120. Fasteners 124 fix the sections 120 and 122 to one another, and also preferably serve to attach the respective handle 116 or 118 along the corresponding bar 24 or 26. It will be appreciated that the telescopically interfitted portion of each bar is aligned with the corresponding handle, although this configuration is not required. Furthermore, the illustrated bar sections 120 and 122 comprise cylindrical tubes, preferably formed of metal. The principles of the present invention are equally applicable to alternative bar designs and materials.

As perhaps best shown in FIG. 7, the upper ends 108 and 110 of the bars 24 and 26 are each provided with a sleeve 126. The sleeve 126 is preferably in the form a cylindrical tube with the central opening 128 being configured to rotatably receive the corresponding shaft 50. Thus, in the illustrated embodiment, the bars 24 and 26 cooperate with the bracket 28 to define the upper pivot joints 34 and 36.

Turning to FIGS. 2 and 4, the lower pivot joints 30 and 32 are similarly defined by sleeves 130 at the lower ends 112 and 114 of the bars 24 and 26, with each of the sleeves 130 rotatably receiving a corresponding shaft 50. It is further noted that the preferred swing 10 includes flexible corrugated covers 132 secured by fasteners 134 in a covering relationship over the joints 30 and 32. The covers 132 are preferably molded of a plastic material. The covers 132 protect the joints 30 and 32 and restrict user access thereto. Those of ordinary skill in the art will appreciate that alternative pivot joint configurations are within the ambit of the present invention. Furthermore, the pivot joints need not be positioned in a symmetric manner, as depicted in the illustrated embodiment (e.g., the pivot joints could be positioned at different vertical heights, which might cause the suspension bars to have different lengths).

Preferably, the lower ends 112 and 114 do not project substantially below the platform member 22, thereby enhancing the visual appearance of the swing 10 and minimizing the risk of injury to bystanders. In the illustrated embodiment, the bars 24 and 26 terminate above the platform member 22, as a result of the lower pivot joints 30 and 32 (defined by the shafts 100 and sleeves 130) being positioned above the top surface 74 of the platform member 22. Furthermore, the platform member 22 projects laterally outward from the bars 24 and 26 and, in the illustrated embodiment, the lower pivot joints 30 and 32. It is specifically noted that the platform member 22 is designed so that the feet of the user are comfortably placed outboard of the bars 24 and 26. Yet further, the platform member is designed so that the feet are placed outboard of the bars in the swing direction, which happens to be in the fore-and-aft direction in the illustrated embodiment. With this arrangement, along with the bowed configuration of the bars 24 and 26, the user is able to securely and comfortably stand on the platform member and grasp the bars while swinging in the fore-and-aft direction.

Figure 3:
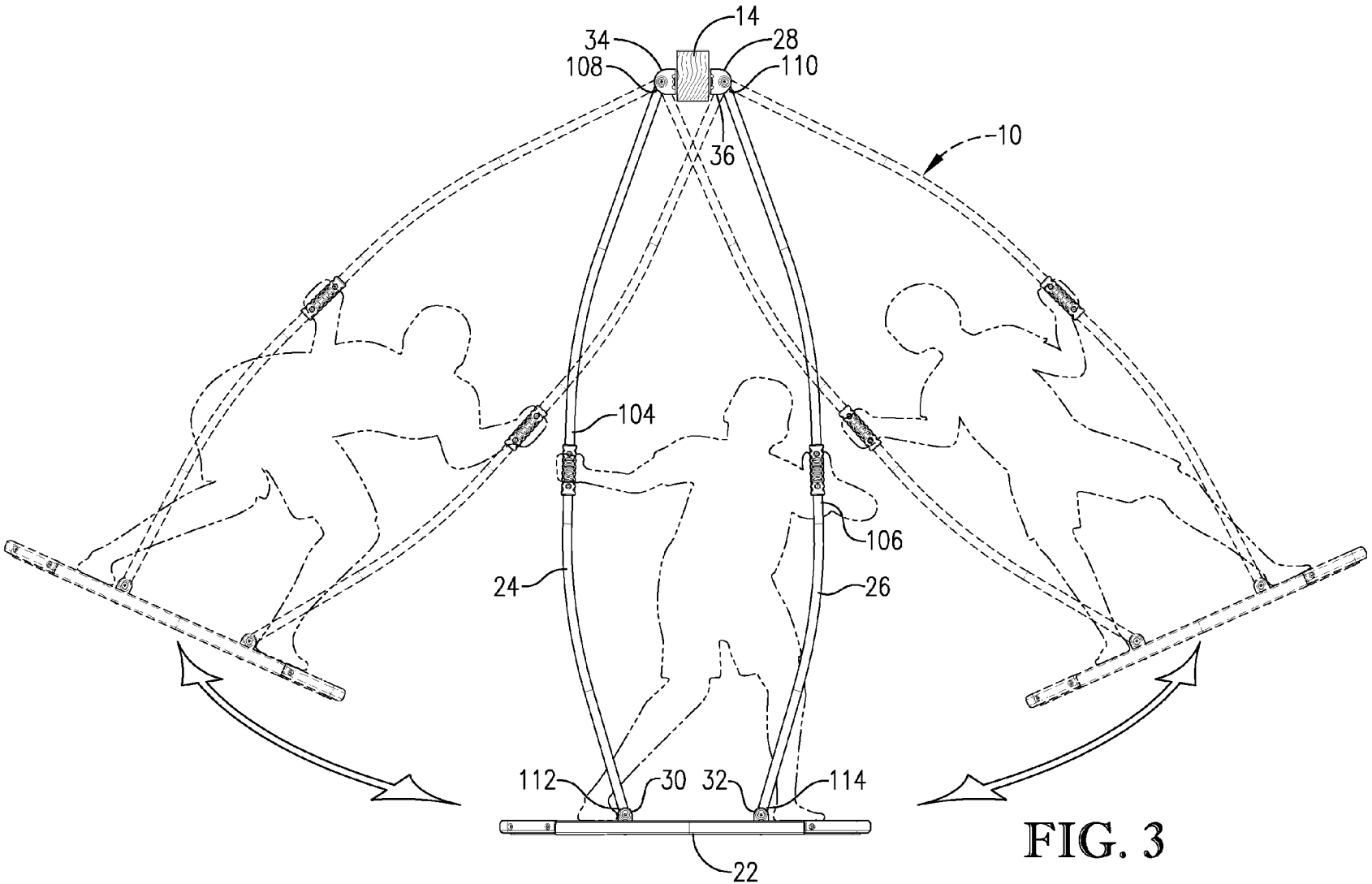
FIG. 3 is a side elevation view of the stand-on swing shown in FIGS. 1 and 2, particularly illustrating the swing in use with a person standing on the platform member and holding onto the suspension bars as the swings moves back-and-forth.

The swing 10 rests in the solid line position shown in FIG. 3, with its center of gravity being disposed in line with the cross-member 14. The user mounts the platform member 22 with his/her feet preferably positioned on the top surface 74 just outboard of the bars 24 and 26. The forward foot is preferably placed in the recessed portion 84 against the stop 80, and the rear foot is placed behind the bar 26 and against the stop 82. The user conveniently grasps the handles 116 and 118 and then appropriately shifts his/her weight to cause the swing 10 to move in the fore-and-aft direction, as depicted by the arrows in FIG. 3.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby state their intent to rely on the Doctrine of Equivalents to determine and access the reasonably fair scope of the present invention as pertains to any apparatus not materially departing from but outside the literal scope of the invention set forth in the following claims.

What is claimed is:

1. A stand-on swing connectable to a structure and operable to support a user in a standing position, said stand-on swing comprising:

a platform member presenting a lower surface and an upper surface on which the user may stand;

a pair of elongated, rigid suspension bars each presenting upper and lower ends, said bars being pivotally connectable to the structure adjacent the upper ends so as to depend therefrom, with the lower ends being spaced from the ground; and a pair of lower pivot joints pivotally connecting the suspension bars to the platform member adjacent the lower ends thereof, with the platform member and bars being swingable in a fore-and-aft direction, said bars located entirely above the lower surface of the platform member, with the bars and the lower pivot joints being prevented from extending downward beyond the lower surface of the platform member.

2. The stand-on swing as claimed in claim 1,
said platform member projecting laterally outward in the fore-and-aft direction beyond the lower pivot joints.
3. The stand-on swing as claimed in claim 2,
said platform member presenting fore-and-aft ends and including bumpers positioned along the fore-and-aft ends.
4. The stand-on swing as claimed in claim 2,
said platform member cooperating with the suspension bars to define the lower pivot joints.
5. The stand-on swing as claimed in claim 4,
each of said lower pivot joints including a shaft fixed to one of the platform member and corresponding suspension bar and a relatively rotatably sleeve fixed to the other of the platform member and corresponding suspension bar.
6. The stand-on swing as claimed in claim 2,
said upper surface of the platform member including a substantially flat portion and a pair of foot stops projecting upwardly from the flat portion,
said foot stops being located laterally outward from the lower pivot joints.
7. The stand-on swing as claimed in claim 1; and
a pair of upper pivot joints operable to pivotally support the suspension bars and platform member on the structure.
8. The stand-on swing as claimed in claim 7; and
a connection bracket configured for secure connection to the structure,
said connection bracket cooperating with the suspension bars to define the upper pivot joints.
9. The stand-on swing as claimed in claim 8,
each of said upper pivot joints including a shaft fixed to one of the connection bracket and corresponding suspension bar and a relatively rotatably sleeve fixed to the other of the connection bracket and corresponding suspension bar.
10. The stand-on swing as claimed in claim 1,
said bars being bowed in the fore-and-aft direction so as to present intermediate sections that are spaced further apart than the upper and lower ends.
11. The stand-on swing as claimed in claim 10,
said suspension bars being entirely separated and spaced apart from one another between the upper and lower ends.
12. The stand-on swing as claimed in claim 10,
said lower ends being spaced further apart than the upper ends.
13. The stand-on swing as claimed in claim 10,
each of said suspension bars being provided with a handle positioned within the intermediate section.
14. The stand-on swing as claimed in claim 13,
each of said suspension bars including a pair of telescopically interfitted sections that are interconnected at a location at least substantially aligned with the handle.
15. A stand-on swing connectable to a structure and operable to support a user in a standing position, said stand-on swing comprising:
a platform member presenting an upper surface on which the user may stand;
a pair of elongated, rigid suspension bars each presenting upper and lower ends,
said bars being pivotally connectable to the structure adjacent the upper ends so as to depend therefrom, with the lower ends being spaced from the ground; and
a pair of lower pivot joints pivotally connecting the suspension bars to the platform member adjacent the lower ends thereof, with the platform member and bars being swingable in a fore-and-aft direction,
said bars being bowed so as to present intermediate sections that are spaced further apart than the upper ends and further apart than the lower ends.
16. The stand-on swing as claimed in claim 15,
said suspension bars being entirely separated and spaced apart from one another between the upper and lower ends.
17. The stand-on swing as claimed in claim 15,
said lower ends being spaced further apart than the upper ends.
18. The stand-on swing as claimed in claim 15
said bars being bowed in the fore-and-aft direction.
19. The stand-on swing as claimed in claim 15,
each of said suspension bars being provided with a handle positioned within the intermediate section.
20. The stand-on swing as claimed in claim 19,
each of said suspension bars including a pair of telescopically interfitted sections that are interconnected at a location at least substantially aligned with the handle.
21. The stand-on swing as claimed in claim 15,
said platform member projecting laterally outward in the fore-and-aft direction beyond the lower pivot joints.
22. The stand-on swing as claimed in claim 21,
said platform member presenting fore-and-aft ends and including bumpers positioned along the fore-and-aft ends.
23. The stand-on swing as claimed in claim 21,
said platform member cooperating with the suspension bars to define the lower pivot joints.
24. The stand-on swing as claimed in claim 23,
each of said lower pivot joints including a shaft fixed to one of the platform member and corresponding suspension bar and a relatively rotatably sleeve fixed to the other of the platform member and corresponding suspension bar.
25. The stand-on swing as claimed in claim 21,
said upper surface of the platform member including a substantially flat portion and a pair of foot stops projecting upwardly from the flat portion,
said foot stops being located laterally outward from the lower pivot joints.
26. The stand-on swing as claimed in claim 15; and
a pair of upper pivot joints operable to pivotally support the suspension bars and platform member on the structure.
27. The stand-on swing as claimed in claim 26; and
a connection bracket configured for secure connection to the structure,
said connection bracket cooperating with the suspension bars to define the upper pivot joints.
28. The stand-on swing as claimed in claim 27,
each of said upper pivot joints including a shaft fixed to one of the connection bracket and corresponding suspension bar and a relatively rotatably sleeve fixed to the other of the connection bracket and corresponding suspension bar.

* * * * *